United States Patent [19]

Oncale

[11] Patent Number: 4,824,064

[45] Date of Patent: Apr. 25, 1989

[54] VERTICAL DRAWING BOARD

[76] Inventor: Russell P. Oncale, 506 Parish Rd., Thibodaux, La. 70301

[21] Appl. No.: 189,951

[22] Filed: May 3, 1988

[51] Int. Cl.[4] ..... A47B 19/00

[52] U.S. Cl. ..... 248/441.1; 312/312

[58] Field of Search ..... 108/107, 144; 248/441.1; 312/231, 306, 312

[56] References Cited

U.S. PATENT DOCUMENTS

| | | | |
|---|---|---|---|
| 1,477,409 | 12/1923 | Woolman . | |
| 2,680,932 | 6/1954 | Rotschild . | |
| 2,729,018 | 1/1956 | Morgan . | |
| 3,926,398 | 12/1975 | Vincent | 248/460 |
| 4,099,469 | 7/1978 | Sahli . | |
| 4,568,132 | 2/1986 | Watt | 312/312 |
| 4,576,424 | 3/1986 | Nelson . | |

FOREIGN PATENT DOCUMENTS

| | | | |
|---|---|---|---|
| 526061 | 10/1921 | France | 312/231 |

*Primary Examiner*—Joseph Falk

*Attorney, Agent, or Firm*—Jerry T. Kearns

[57] ABSTRACT

A vertical drawing board is supported by two A-frame supports, each formed by a pair of pivotally connected legs positioned adjacent opposite sides of the drawing board. Each pair of support legs is retained in an open configuration by a telescoping support strut. The front surface of the drawing board is supported at about a fifteen degree angle with respect to a vertical line. Slide support rods are provided on the A-frame for supporting the drawing board for sliding movement parallel to the front surface of the drawing board. A pulley mounted on a top pivot pin of one of the A-frame supports receives a cable having one end secured to the drawing board and an opposite end attached to a counterweight. By virtue of this arrangement, the drawing board may easily be adjusted and will remain in a selected position without need for any form of fasteners. In a second embodiment, a ratchet pulley mechanism is provided for raising or lowering the drawing board in discreet increments. The ratchet pulley is provided with two spools mounted on a common shaft. A first cable wound on a first spool is secured to the drawing board and a second cable wound on a second spool is secured to a counterweight. This arrangement allows the drawing board to be adjusted up or down in discreet increments with a minimum of force.

4 Claims, 6 Drawing Sheets

VERTICAL DRAWING BOARD

BACKGROUND OF THE INVENTION

1. Field of the Invention

The present invention relates to drawing boards, and more particularly pertains to a new and improved vertical drawing board with an inclined surface which may be adjusted in height for use by a variety of individuals. Conventional forms of drawing tables are provided with a work surface which may be adjusted at any desired angle. However, these conventional forms of tables are disadvantageous because they require a relatively large amount of floor space. Chalk boards are currently available, which are mounted on slide runners for adjustment along a generally vertical axis. However, the weight of these chalk boards make them difficult to adjust. Additionally, these conventional forms of chalk boards are generally mounted in a fixed location in a classroom and thus are not easily transportable. In order to overcome these problems, the present invention provides a portable vertical drawing board with a counterweight mechanism for allowing the drawing board to be adjusted for height for usage by short or tall individuals. Additionally, this adjustability enables the top and bottom portions of a drawing or large layout to be easily accessed.

2. Description of the Prior Art

Various types of drawing boards are known in the prior art. A typical example of such a drawing board is to be found in U.S. Pat. No. 1,477,409, which issued to R. Woolman on Dec. 11, 1923. This patent discloses a drawing table which has a working surface which may be adjusted in elevation and inclination. A slotted portion formed in a supporting standard is secured in an adjusted position by a clamp bolt. U.S. Pat. No. 2,680,932, which issued to A. Rotschild on June 15, 1954, discloses a foldable artwork support which may be folded to a compact size for transportation in a suitcase assembly. U.S. Pat. No. 2,729,018, which issued to F. Morgan on Jan. 3, 1956, discloses an easel which is adjustable both in elevation and in inclination. U.S. Pat. No. 4,099,469, which issued to F. Sahli on July 11, 1978, discloses a drafting table which can be folded together so as to occupy very little space during transportation or storage. The table comprises two outriggers, two supporting columns and a table surface. The supporting columns are each composed of two telescoped bars, and the outriggers are respectively pivotable about the inner of these bars. U.S. Pat. No. 4,576,424, which issued to J. Nelson on Mar. 18, 1986, discloses an artist's work station which is formed as a generally rectangular cabinet having a plurality of drawers therein. A top section of the cabinet may be lifted and rotated outwardly to form a drawing board which is angularly adjustable. The drawing board is mounted on a U-shaped support disposed within the cabinet and is pivotally attached to the forward edge thereof. The support forms J-slots in opposed legs of the U. The cabinet frame supports outstanding walls received within the U which mount rollers adapted to ride in the J-slots.

While the above mentioned devices are suited for their intended usage, none of these devices disclose an adjustable drawing board with a counterweight or ratchet pulley mechanism. Inasmuch as the art is relatively crowded with respect to these various types of drawing boards, it can be appreciated that there is a continuing need for and interest in improvements to such drawing boards, and in this respect, the present invention addresses this need and interest.

SUMMARY OF THE INVENTION

In view of the foregoing disadvantages inherent in the known types of drawing boards now present in the prior art, the present invention provides an improved vertical drawing board. As such, the general purpose of the present invention, which will be described subsequently in greater detail, is to provide a new and improved vertical drawing board which has all the advantages of the prior art drawing boards and none of the disadvantages.

To attain this, representative embodiments of the concepts of the present invention are illustrated in the drawings and make use of a generally vertical drawing board supported by two pairs of pivotally connected legs positioned adjacent opposite sides of the drawing board. Each pair of support legs is retained in an open configuration by a telescoping support strut. When in an operative position, each pair of support legs has the general configuration of an A-frame. The front surface of the drawing board is supported at about a fifteen degree angle with respect to a vertical line. Slide support rails are provided on the A-frame at each side of the drawing board for supporting the drawing board for sliding movement parallel to the front surface of the drawing board. A pulley mounted on a top pivot pin of one of the A-frame supports receives a cable having one end secured to the drawing board and an opposite end attached to a counterweight. By virtue of this arrangement, the drawing board may easily be adjusted and will remain in a selected position without need for any form of fasteners. In a second embodiment, a ratchet pulley mechanism is provided for raising or lowering the drawing board in discreet increments. The ratchet pulley is provided with tube spools mounted on a common shaft. A first cable wound on a first spool is secured to the drawing board and a second cable wound on a second spool is secured to a counterweight. This arrangement allows the drawing board to be adjusted up or down in discreet increments with a minimum of force.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved vertical drawing board which has all the advantages of the prior art drawing boards and none of the disadvantages.

It is another object of the present invention to provide a new and improved vertical drawing board which may be easily and efficiently manufactured and marketed.

It is a further object of the present invention to provide a new and improved vertical drawing board which is of a durable and reliable construction.

An even further object of the present invention is to provide a new and improved vertical drawing board which is susceptible of a low cost of manufacture with regard to both materials and labor, and which accordingly is then susceptible of low prices of sale to the consuming public, thereby making such drawing boards economically available to the buying public.

Still yet another object of the present invention is to provide a new and improved vertical drawing board which provides in the apparatuses and methods of the prior art some of the advantages thereof, while simultaneously overcoming some of the disadvantages normally associated therewith.

Still another object of the present invention is to provide a new and improved vertical drawing board which is adjustable in inclination and elevation.

Yet another object of the present invention is to provide a new and improved vertical drawing board which utilizes a counterweight and pulley mechanism to enable vertical adjustment of the drawing board with a minimum of effort.

Even still another object of the present invention is to provide a new and improved vertical drawing board which utilizes a ratchet pulley and counterweight mechanism to enable vertical adjustment in discreet increments with a minimum of effort.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a partial perspective view of the vertical drawing board according to the first embodiment of the present invention.

FIG. 6 is a cross sectional side view illustrating the counterweight and pulley mechanism of the vertical drawing board according to the first embodiment of the present invention.

DESCRIPTION OF THE PREFERRED EMBODIMENT

Figure 1:
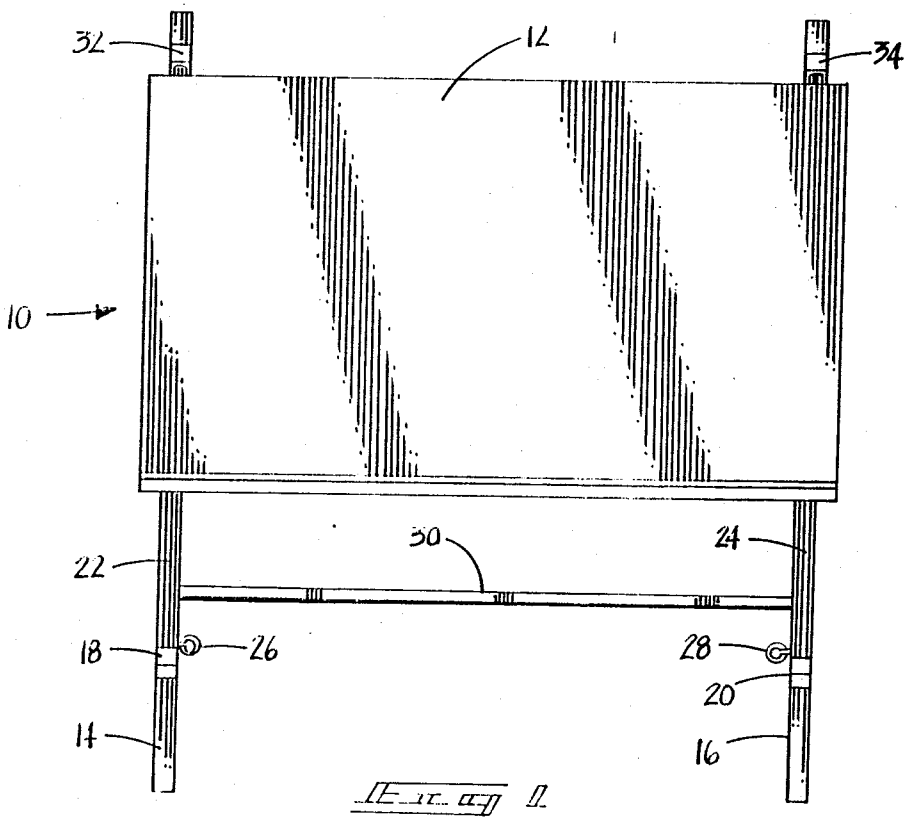
FIG. 1 is a front view of the vertical drawing board according to the first embodiment of the present invention.

With reference now to the drawings, and in particular to FIG. 1 thereof, a new and improved vertical drawing board embodying the principles and concepts of the present invention and generally designated by the reference numeral 10 will be described.

More specifically, it will be noted that the first embodiment 10 of the invention includes a rectangular planar drawing board 12. The drawing board 12 may be a chalk board or may be provided with conventional fastening means for securing paper or an artist's canvas thereon. The drawing board 12 is supported in a generally vertical slightly inclined orientation by a pair of spaced A-frames. The front legs 14 and 16 of these A-frames may be seen in FIG. 1. A cylindrical slide guide rod 22 is secured by mounting blocks 18 and 32 on the front outer surface of the support leg 14. A similar cylindrical slide guide rod 24 is secured by spaced mounting blocks 20 and 34 on the front outer surface of the support leg 16. The drawing board 12 is mounted for sliding movement along the guide rods 22 and 24. Thus, the height of the drawing board 12 may be adjusted to suit the needs of each individual user. A horizontal tray 30 is mounted between the A-frames for storage of pens, pencils or other graphic artist's materials.

Figure 2:
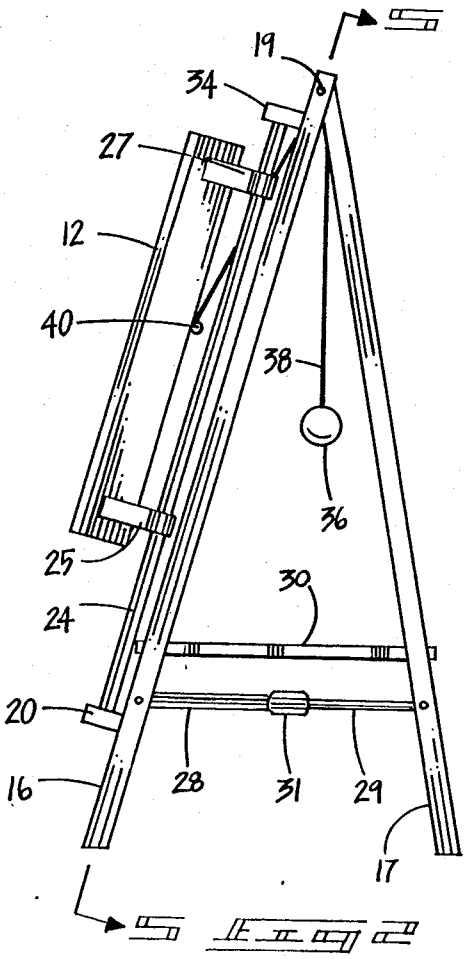
FIG. 2 is a side view of the vertical drawing board according to the first embodiment of the present invention.

In FIG. 2, a side view illustrates the A-frame at the right hand side of the drawing board 12. The right hand A-frame is formed by a front support leg 16 and a rear support leg 17 which are pivotally connected by a pivot pin 19. A telescoping support strut is formed by a first hollow cylindrical tube 28 which telescopically receives a second strut 29. The end of the hollow strut 28 may be provided with a circumferential array of spaced longitudinal slits which form a collet for engagement with the second support strut 29. A slide ring 31 secures the second support strut 29 in an adjusted position within the first hollow support strut 28. By adjusting the spacing of the front and rear support legs 16 and 17, the inclination of the surface of the drawing board 12 may be varied. The frame of the drawing board 12 is provided with spaced cylindrical slide journal bearings 25 and 27 which receive the guide rod 24 in close fitting relation. A cable 38 is secured to an eye bolt 40 on a back surface of the drawing board 12. A counterweight 36 is secured to an opposite end of the cable 38. The cable 38 is supported by a pulley suspended from the pivot pin 19. The weight of the counterweight 36 equals that of the drawing board 12. This allows the drawing board 12 to be easily adjusted with a minimum of exertion along the length of the guide rods 22 and 24, while at the same time, allowing the drawing board 12 to be maintained in a selected adjusted position by virtue of friction between the journal bearings 25 and 27 and the guide rods 22 and 24.

In FIG. 3, a perspective view illustrates the counter weight adjustment mechanism.

Figure 4:
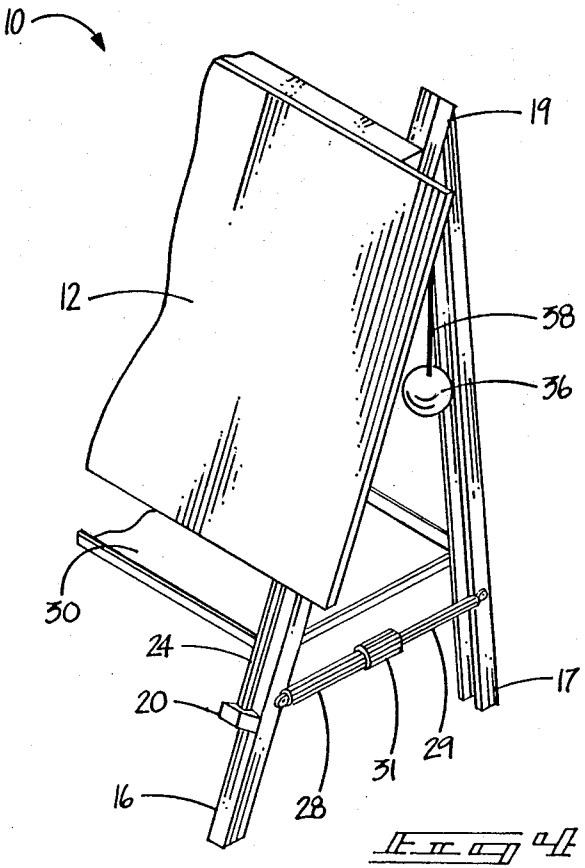
FIG. 4 is a partial perspective view of the vertical drawing board according to the first embodiment of the present invention.

In FIG. 4, another perspective view from a front angle of the drawing board 12 further illustrates the counter weight mechanism.

Figure 5:
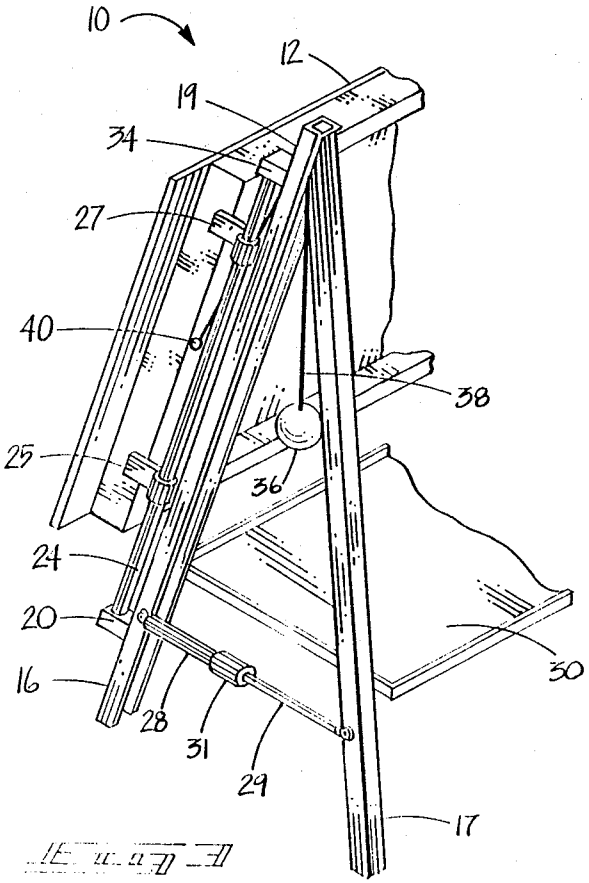
FIG. 5 is a longitudinal cross sectional view, taken along line 5—5 of FIG. 2, illustrating the pulley mechanism of the vertical drawing board according to the first embodiment of the present invention.

As shown in the cross sectional view of FIG. 5, a pulley bracket 44 is secured by a hook 42 to the pivot pin 19. The sheave 46 of the pulley supports the cable 38.

As shown in FIG. 6, the counterweight 36 is suspended by the cable 38 from the pulley sheave 46.

Figure 7:
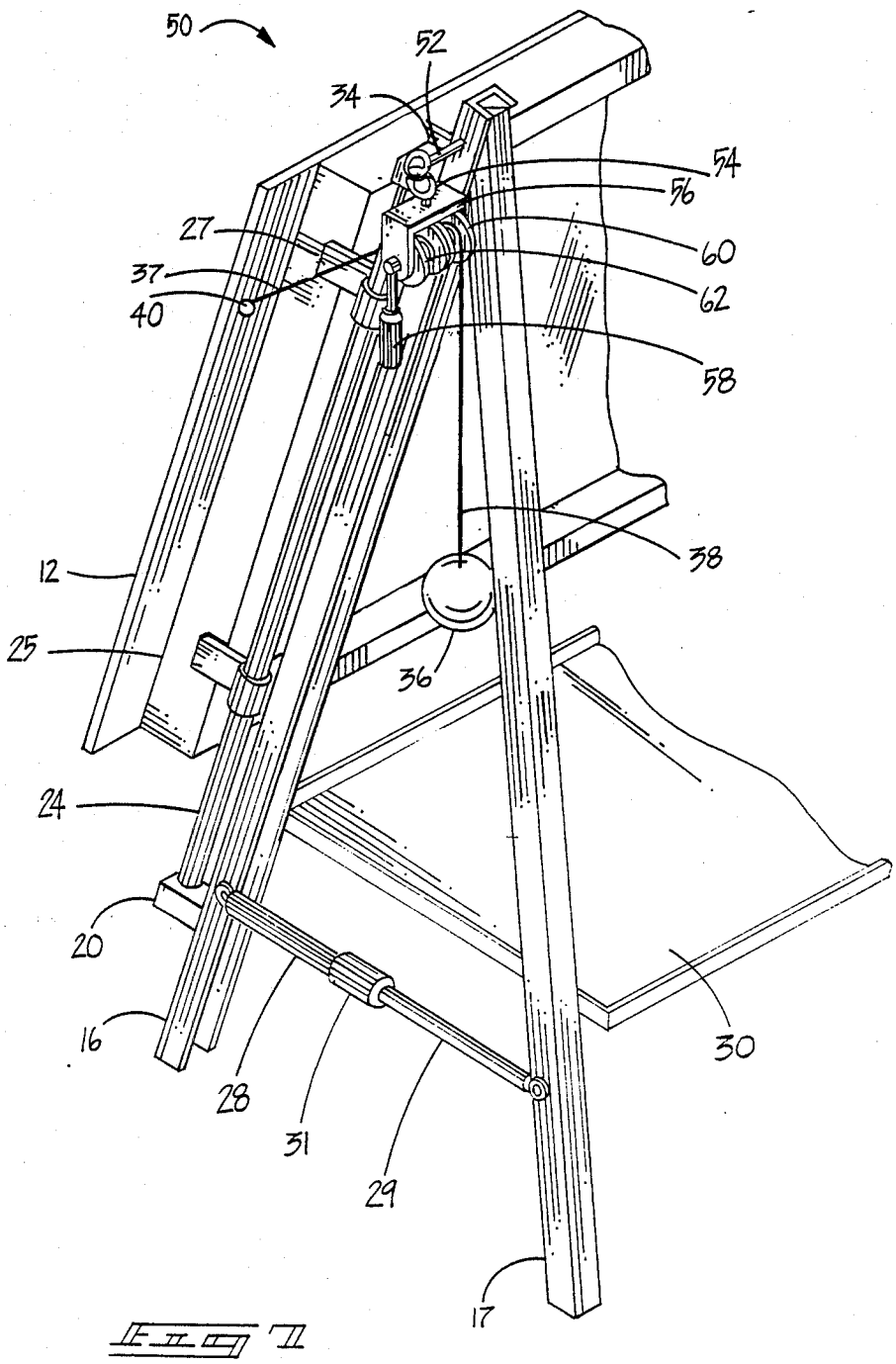
FIG. 7 is a partial perspective view illustrating the ratchet pulley and counterweight adjustment mechanism of the vertical drawing board according to a second embodiment of the present invention.

In FIG. 7, a partial perspective view is provided of a vertical drawing board 50 according to a second embodiment of the present invention. The second embodiment 50 is identical in all respects with that of the first embodiment, except that a ratchet pulley mechanism is employed to enable the drawing board 12 to be adjusted in elevation in discreet increments. The ratchet pulley mechanism is mounted on a rod 52 which extends transversely from an apex of one of the supporting A-frames. A pulley bracket 56 is supported by an eye bolt 54 from the rod 52. Two spools 60 and 62 are mounted for rotation with a common shaft which is connected for rotation by a handle 58. The counterweight 36 is supported by a cable 38 wound in a first direction around the spool 60. The drawing board is connected to a second cable 37 wound in an opposite direction around the spool 62. Thus, as the handle 58 is rotated clockwise in FIG. 7, the drawing board 12 will be raised and the counter weight 36 will be lowered. If the handle 58 is rotated in a counter-clockwise direction, the drawing board 12 will be lowered and the counterweight 36 will be raised. This counterweight mechanism balances the pulleys 60 and 62 on a common shaft and allows adjustment of the elevation of the drawing board 12 with a minimum of effort. As in the first embodiment 10 of the present invention, the counterweight 36 has the same weight as the slidable drawing board assembly 12.

Figure 8:
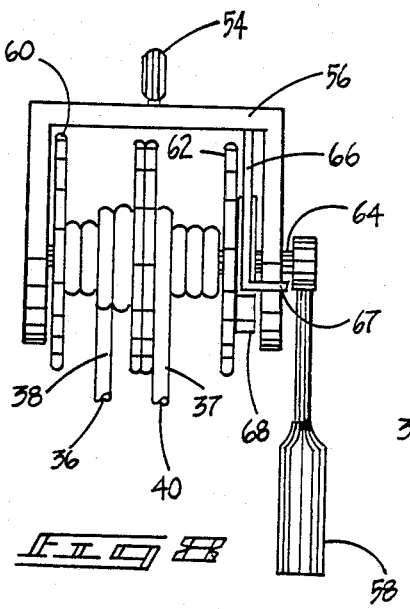
FIG. 8 is a front view of the ratchet pulley adjustment mechanism according to the second embodiment of the present invention.

In FIG. 8, a front view of the ratchet pulley mechanism of the second embodiment of the present invention is illustrated. The spools 60 and 62 are fixed for rotation on a common shaft 64. A ratchet gear 68 is also secured for rotation on the shaft 64. A spring steel pawl 66 extends from a top portion of the bracket 56 for engagement with the gear 68. A transversely extending leg portion 67 of the pawl 66 enables a user to disengage the pawl 66 from the gear 68, allowing the handle 58 to be rotated in an opposite direction. The cable 37 wound on the spool 62 is connected at 40 to the drawing board 12. The cable 38 wound in an opposite direction on the spool 60 is connected to the counterweight 36.

Figure 9:
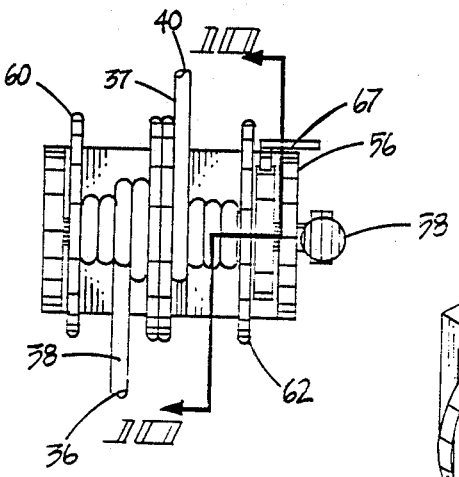
FIG. 9 is an end view of the ratchet pulley mechanism according to the second embodiment of the present invention.
Figure 11:
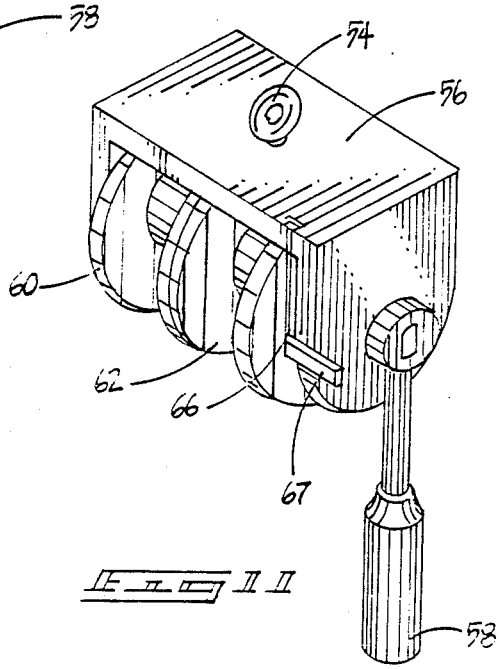

In FIG. 9, a bottom view of the ratchet pulley mechanism is provided.

Figure 10:
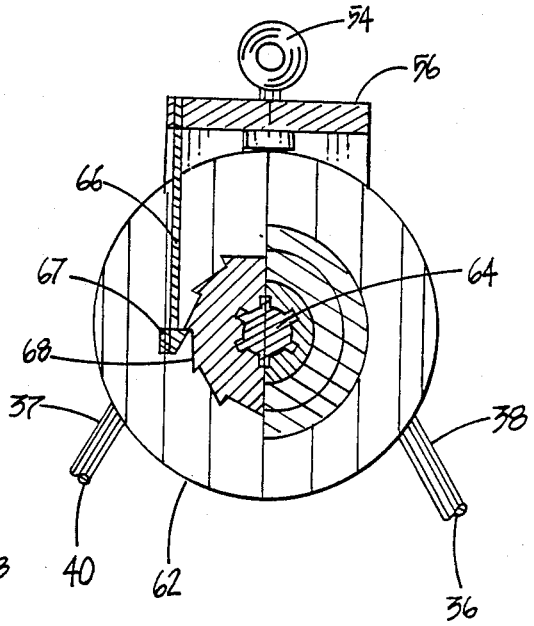
FIG. 10 is a cross sectional view, taken along line 10—10 of FIG. 9, illustrating the constructional details of the ratchet pulley mechanism according to the second embodiment of the present invention.

As shown in the cross sectional view of FIG. 10, the spring steel pawl 66 extends into engagement with the ratchet gear 68. The transversely extending leg portion 67 allows the pawl 66 to be manually disengaged from the gear 68. Upon release of the leg 67, the pawl 66 will return to engagement with the gear 68 by virtue of its resilient nature.

Figure 11:
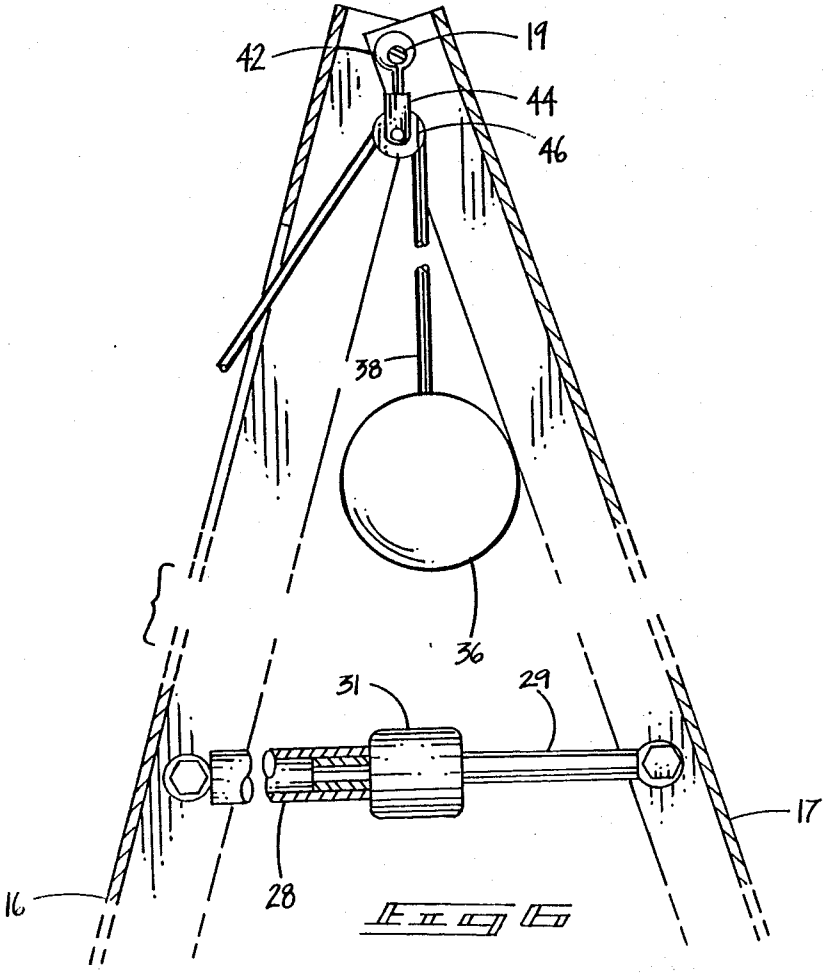
FIG. 11 is a perspective view of the ratchet pulley mechanism according to the second embodiment of the present invention.
Figure 11A:
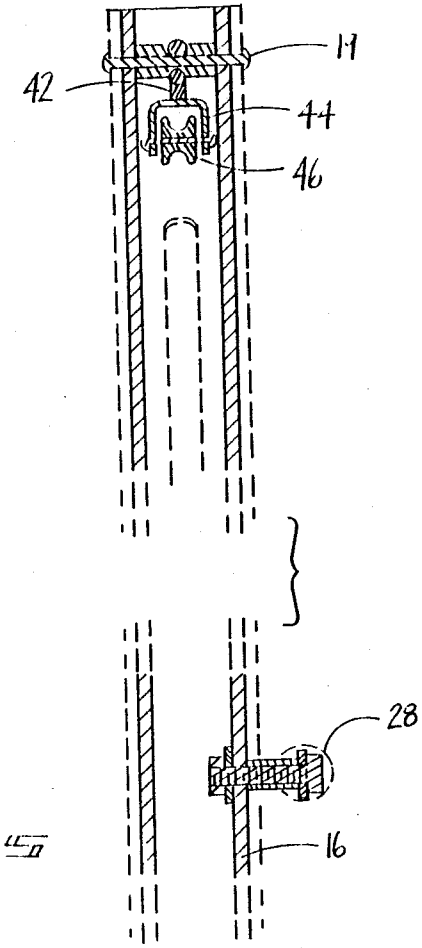

In FIG. 11, a perspective view of the ratchet pulley mechanism is provided. As may now be understood, the handle 58 may be rotated in a first direction to incrementally adjust the elevation of the vertical drawing board 12. To move the vertical drawing board in an opposite direction, the pawl 66 is disengaged by manipulation of the leg portion 67, and the handle 58 is turned in an opposite direction. As an alternative, the drawing board 12 may be slightly heavier than the counterweight 36, which will cause the drawing board 12 to slowly slide downwardly along the guide rods 22 and 24 upon disengagement of the pawl 66. By releasing the leg portions 67 of the pawl 66, the vertical descent of the drawing board 12 may be stopped at any selected position. In order to then raise the drawing board 12, the handle 58 is then rotated allowing the drawing board 12 to be raised in discreet increments by virtue of the engagement of the pawl 66 with the ratchet gear 68.

Figure 12:
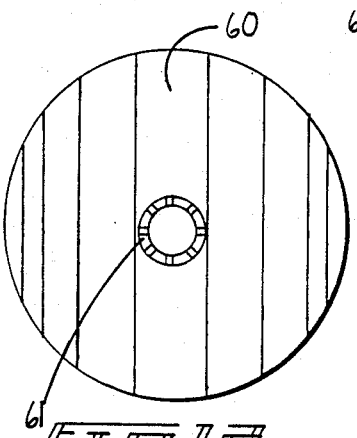
FIG. 12 is a side view of a spool of the ratchet pulley mechanism according to the second embodiment of the present invention.

FIG. 12 provides a side view of the spool 60. The spool 60 has a central splined aperture 61 for the reception of the splined shaft 64. The spool 62 is formed identically as spool 60 and need not be further described.

Figure 13:
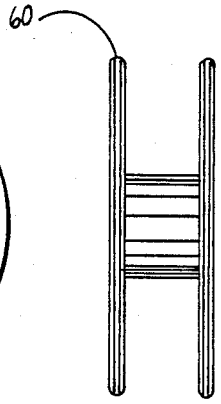
FIG. 13 is a front view of the spool of FIG. 12.

FIG. 13 provides a front view of the spool 60.

Figure 14:
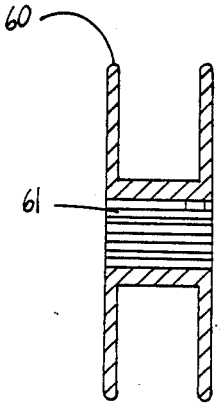
FIG. 14 is a cross sectional view of the spool of FIG. 13.

FIG. 14 provides a cross sectional view of the spool 60, illustrating the central splined aperture 61.

Figure 15:
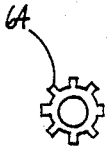
FIG. 15 is an end view of the ratchet gear mounting shaft of the ratchet pulley mechanism according to the second embodiment of the present invention.

FIG. 15 provides an end view of the splined gear shafts 64.

Figure 16:
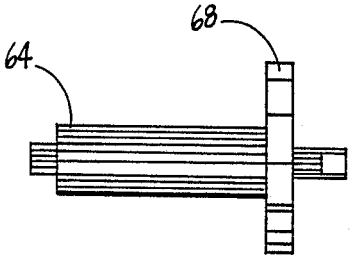
FIG. 16 is a side view of the ratchet gear and supporting shaft of the ratchet pulley mechanism according to the second embodiment of the present invention.

As shown in FIG. 16, the ratchet gear 68 is secured adjacent one end of the shaft 64 for rotation therewith.

Figure 17:
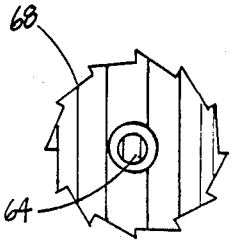
FIG. 17 is an end view of the ratchet gear mounted on the supporting shaft.

FIG. 17 provides an end view of the shaft 64 with the ratchet gear 68 mounted thereon.

Figure 18:
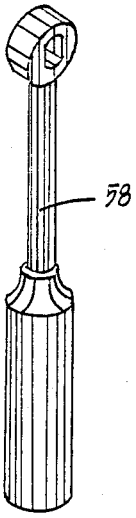
FIG. 18 is a perspective view of the actuation handle of the ratchet pulley mechanism according to the second embodiment of the present invention.

FIG. 18 provides a perspective view of the actuation handle 58. The handle 58 has an aperture configured for engagement with a flattened end portion of the shaft 64.

Figure 19:
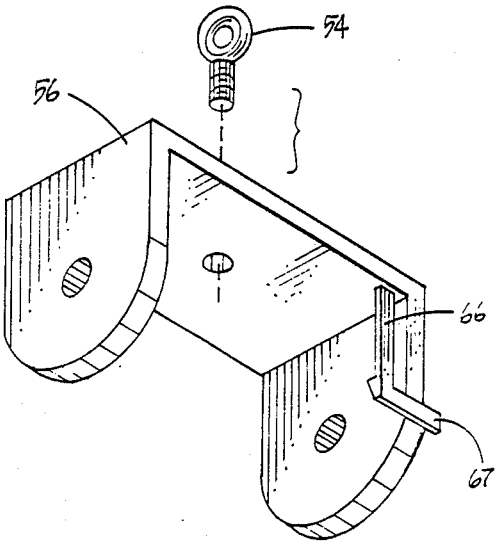
FIG. 19 is a perspective view illustrating the supporting bracket of the ratchet pulley mechanism according to the second embodiment of the present invention.

As illustrated in FIG. 19, the pulley bracket 56 has the shape of a generally rectangular channel and is provided with an eye bolt 54 for securement on the frame of the drawing board. The spring steel pawl 66 has an integrally formed transversely extending leg 67 for disengagement purposes. The pawl 66 is formed of a spring steel material and is secured to the bracket 56 as illustrated.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A vertical drawing board, comprising:

a generally rectangular drawing board;

a pair of spaced A-frames;

an elongated slide guide rod mounted on each of said A-frames;

journal bearing means mounting said drawing board for sliding adjustment along said slide guide rods;

a pulley secured at an apex of one of said A-frames;

a cable around said pulley having one end secured to said drawing board and having a counterweight secured to an opposite end;

and a ratchet actuation mechanism connected to said pulley for enabling adjustment of said drawing board in discreet increments.

2. The vertical drawing board of claim 1, wherein said pulley further comprises a bracket;

a splined shaft supported for rotation by said bracket;

first and second spools mounted for rotation with said shafts;

a ratchet gear mounted for rotation with said shaft;

a spring steel pawl secured to said bracket for engagement with said ratchet gear;

a transversely extending leg on said pawl for disengagement of said pawl from said ratchet gear;

an actuation handle attached to one end of said shaft;

a first cable wound in a first direction around said first spool and having one end secured to said drawing board;

and a second cable wound in an opposite direction around said second spool and having one end secured to said counterweight.

3. The vertical drawing board of claim 1, wherein said counterweight has the same weight as said drawing board.

4. The vertical drawing board of claim 1, wherein said counterweight weighs slightly less than said drawing board.

* * * * *